US005408042A

United States Patent [19]

Masuda

[11] Patent Number: 5,408,042

[45] Date of Patent: Apr. 18, 1995

[54] MUSICAL TONE SYNTHESIZING APPARATUS CAPABLE OF CONVOLUTING A NOISE SIGNAL IN RESPONSE TO AN EXCITATION SIGNAL

[75] Inventor: Hideyuki Masuda, Hamamatsu, Japan

[73] Assignee: Yamaha Corporation, Japan

[21] Appl. No.: 6,751

[22] Filed: Jan. 21, 1993

[30] Foreign Application Priority Data

Jan. 20, 1992 [JP] Japan ..... 4-007975

[51] Int. Cl.[6] ..... G10H 1/057; G10H 1/12

[52] U.S. Cl. ..... 84/661; 84/663; 84/DIG. 9; 84/DIG. 10

[58] Field of Search ..... 84/622-633, 84/659-665, DIG. 9, DIG. 10, DIG. 26

[56] References Cited

U.S. PATENT DOCUMENTS 4,130,043 12/1978 Niimi .
4,736,663 4/1988 Wawrzynick et al. .
4,984,276 1/1991 Smith .
5,025,472 6/1991 Shimizu ..... 84/DIG. 26
5,248,845 9/1993 Massie et al. ..... 84/DIG. 10

FOREIGN PATENT DOCUMENTS 2-287395 11/1990 Japan .

*Primary Examiner*—Stanley J. Witkowski
*Attorney, Agent, or Firm*—Graham & James

[57] ABSTRACT

When playing a wind instrument such as a clarinet, noises are inevitably or intentionally generated under effect of a turbulent flow contained in an air-pressure wave propagated through a resonance tube of the wind instrument. In response to an accurate simulation of a noise behavior, particularly, a behavior of the turbulent flow contained in the air-pressure wave, a musical tone synthesizing apparatus artificially produces a noise signal by use of a white-noise signal having the predetermined uniform spectral distribution. Herein, frequency characteristic and amplitude characteristic of this noise signal are controlled to be varied in response to an excitation signal which is created responsive to performance information representing the breath pressure applied to a mouthpiece of the wind instrument. This excitation signal is delayed by the predetermined delay time while it is circulating through a loop circuit. In addition, the signal circulating through the loop circuit is convoluted with the noise signal so as to produce a musical tone signal. Then, the musical tones with desirable noises are produced on the basis of this musical tone signal. Thus, the musical tone synthesizing apparatus well simulates the sound-and -noise-generating mechanism of the wind instrument.

19 Claims, 13 Drawing Sheets

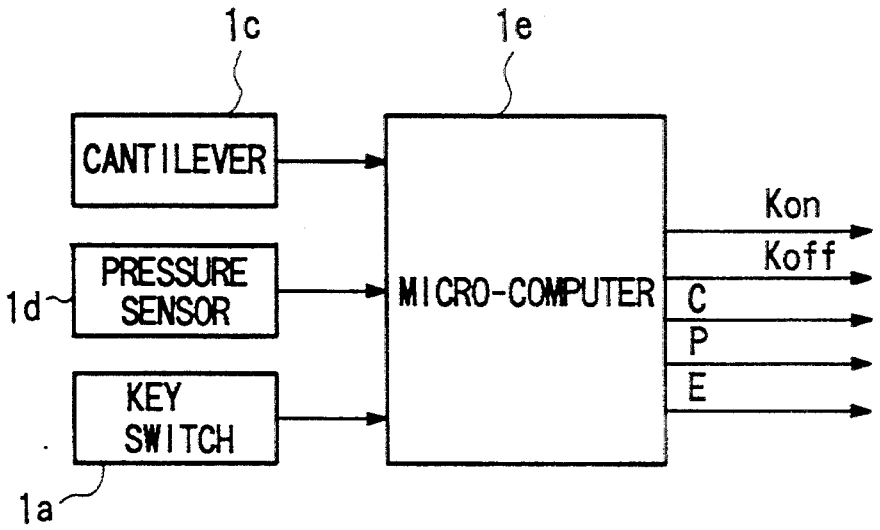
FIG.3
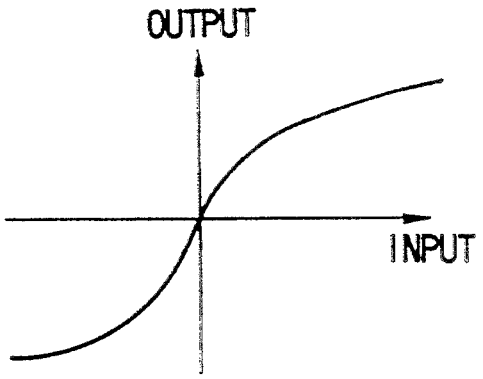
FIG.5 (NON-LINEAR FUNCTION B)

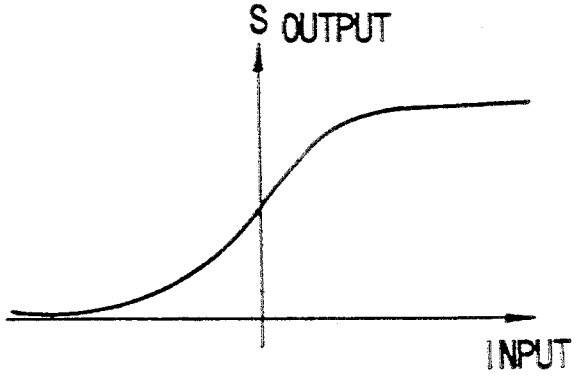
FIG.7 (NON-LINEAR FUNCTION A)
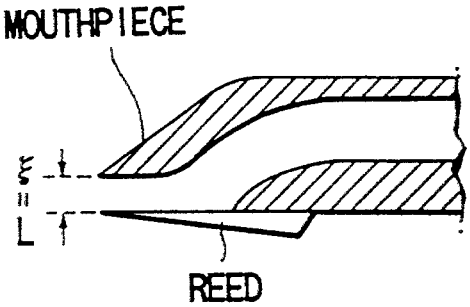
FIG.8A
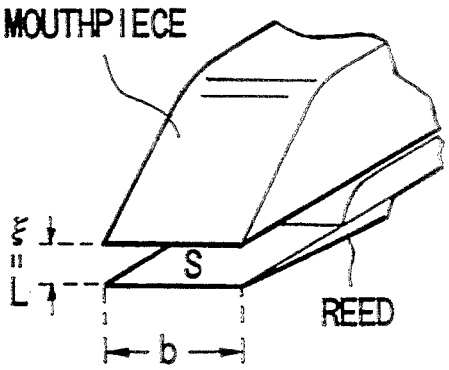
FIG.8B (SATURATION CHARACTERISTIC FOR REYNOLDS NUMBER R)

MUSICAL TONE SYNTHESIZING APPARATUS CAPABLE OF CONVOLUTING A NOISE SIGNAL IN RESPONSE TO AN EXCITATION SIGNAL

BACKGROUND OF THE INVENTION

1. Field of the Invention

The present invention relates to a musical tone synthesizing apparatus which simulates a tone-generation mechanism of a wind instrument so as to synthesize its sounds.

2. Prior Art

Recently, several kinds of musical tone synthesizing apparatuses, each of which synthesizes musical tones of a non-electronic musical instrument by use of a simulation model corresponding to its tone-generation mechanism, have been developed. This kind of technology is disclosed in, for example U.S. Pat. Nos. 4,984,276 and 4,130,043.

FIG. 15 shows a main portion of the conventional musical tone synthesizing apparatus which is designed to simulate the tone-generation mechanism of the wind instrument. In FIG. 15, 11 designates a non-linear circuit which is configured by a read-only memory (ROM) or a random-access memory (R) storing data corresponding to the predetermined non-linear function in form of the tables. In addition, 12 designates an adder, 13 designates a subtracter, while 14 and 15 designate multipliers. These circuit elements 11 to 15 are assembled together to configure a simulation model of which operations correspond to the mouthpiece and reed of the wind instrument such as the clarinet. In short, these circuit elements configure an excitation circuit 10.

Further, 20 designates a bi-directional transmission circuit which simulates the operations of the tube portion of the wind instrument, in other words, transmission characteristic of the resonance tube. This bi-directional transmission circuit 20 contains delay circuits D, Junctions JU, a low-pass filter LPF and a high-pass filter HPF. The delay circuits D simulate the propagation delay of the air-pressure wave propagated through the resonance tube; the Junctions JU are provided to be sandwiched by these delay circuits D; the low-pass filter LPF simulates an energy loss which is occurred when the air-pressure wave is reflected by the end terminal of the resonance tube; and the high-pass filter HPF cuts off the low-frequency component of the signal transmitting through the bi-directional transmission circuit 20.

Each of the junctions JU is provided to simulate the scattering manner of the air-pressure wave which is scattered at the predetermined portion of the resonance tube, wherein the diameter of the tube is changed at the predetermined portion. As the junction shown in FIG. 15, the four-multiplication-grid-type circuit, containing four multipliers M1 to M4 and adders A1, A2, is employed. Herein, "k+1", "−k", "1-k", "k" described with the multipliers M1 to M4 designate respective multiplication coefficients. The value k is determined such that the transmission characteristic of this junction can well simulate that of the actual resonance tube.

In the circuitry shown in FIG. 15, data P corresponding to the blowing pressure to be applied to the mouthpiece of the wind instrument is applied to both of the adder 12 and subtracter 13. Then, the output data of the adder 12 is transmitted through one line consisting of the delay circuit D, junction JU, another delay circuit D . . . , then, reached at the low-pass filter LPF. Thereafter, this data is transmitted through the low-pass filter LPF and high-pass filter HPF, and then also transmitted backward through another line consisting of the delay circuit D, junction JU, another delay circuit D, . . . . Finally, it is outputted from the bi-directional transmission circuit 20, and then supplied to the subtracter 13.

As described above, the output data of the bil-directional transmission circuit 20 may correspond to the pressure of the air-pressure wave which is reflected by the end terminal of the resonance tube and then returned back to the gap between the mouthpiece and reed. In the subtracter 13, the foregoing data P is subtracted from the output data of the bi-directional transmission circuit 20. As a result of the subtraction performed by the subtracter 13, it is possible to obtain data P1 which corresponds to the air pressure applied to the gap between the mouthpiece and reed. This data P1 is supplied to the nonlinear circuit 11, from which data Y is outputted. This data Y corresponds to the sectional area of the gap formed between the mouthpiece and reed, in other words, the admittance imparted to the air flow. Incidentally, the non-linear circuit 11 stores information of non-linear function A which represents the relationship between the air pressure, applied to the gap between the mouthpiece and reed, and sectional area of the gap. Thus, the input data of the non-linear circuit 11 corresponds to the air pressure, while the output data thereof corresponds to the sectional area.

The above-mentioned data P1 and Y are subjected to the multiplication of the multiplier 14, resulting that data FL is obtained. This data FL corresponds to the volume-flow velocity of the air passing through the gap between the mouthpiece and reed. This data FL is multiplied by a multiplication coefficient G in the multiplier 15. Herein, the multiplication coefficient G is a constant which is determined in response to the tube diameter in the vicinity of the mouthpiece of the wind instrument. In other words, this coefficient G correspond to the resistance to the air flow, or impedance imparted to the air flow. Thus, the multiplier 15 outputs a product between the volume-flow velocity of the air flow, passing through the gap between the mouthpiece and reed, and impedance imparted to the air flow propagated through the tube. In other words, this product of the multiplier 15, i.e., data P2, corresponds to the pressure variation to be occurred in the tube under effect of the air flow passing through the gap. This data P2 and the foregoing data P are added together by the adder 12, of which addition result is supplied to the bi-directional transmission circuit 20.

As described above, the data is circulating through the closed loop configured by the excitation circuit 10 and bi-directional transmission circuit 20, while the resonating operation is performed on the circulating data. Then, the input data of the low-pass filter LPF of the bi-directional transmission circuit 20 is picked up for the synthesis of the musical tone. On the basis of this data, the musical tones are produced.

Meanwhile, the so-called "sub-tone performing technique" is sometimes employed when actually performing the wind instrument. In this sub-tone performing technique, the noise component of the sound which is occurred when blowing the breath into the gap between the mouthpiece and reed of the wind instrument is intentionally exaggerated. Conventionally, such composition of the noise is made by convoluting the noise data with the data P corresponding to the blowing pressure.

When actually blowing the breath into the gap between the mouthpiece and reed of the wind instrument, the turbulent flow is caused at the gap, by which the air-pressure wave is scattered in the tube, resulting that the above-mentioned noise component of the sound may be occurred. However, the conventional noise reproducing method, in which the noise data is merely convoluted with the blowing-pressure data, cannot simulate the actual noise-generating mechanism of the wind instrument with accuracy. For this reason, there is a drawback in that the noise produced by the conventional method may lack the natural characteristic of the noise to be actually generated. In the non-electronic instrument such as the clarinet, the ratio of the noise component included in the sound is relatively high just after the sound is produced, however, it is reduced as the sound level becomes constant. However, the conventional method cannot accurately simulate such variation of the noise component included in the sound to be produced.

SUMMARY OF THE INVENTION

Accordingly, it is an object of the present invention to provide a musical tone synthesizing apparatus which can reproduce the noise-producing effect applied to the wind instrument with fidelity by simulating the actual noise-generating mechanism.

In order to accomplish the above-mentioned object, the musical tone synthesizing apparatus according to the present invention is basically configured by an excitation circuit and a loop circuit. Herein, the excitation circuit creates an excitation signal corresponding to performance information. On the other hand, the loop circuit at least delays its input signal by the predetermined delay time, while the excitation signal is repeatedly circulating through the loop circuit. Then, the signal circulating through the loop circuit is extracted and outputted as a musical tone signal. Further, the present invention is characterized by containing a noise creating circuit, a noise control circuit and a noise convolution circuit. In the noise creating circuit, a first noise signal having a uniform spectral distribution is converted into a second noise signal which has the predetermined spectral distribution corresponding to the excitation signal. The noise control circuit controls an envelope waveform of the second noise signal in response to the excitation signal. The noise convolution circuit is provided at the predetermined point within the loop circuit, so that it convolutes the second noise signal with the signal circulating through the loop circuit.

According to the above-mentioned configuration, the noise creating circuit creates the noise signal, of which characteristic is similar to that of the turbulent flow occurred in the tube of the wind instrument, in response to the excitation signal. Then, the noise convolution circuit convolutes the noise signal with the signal circulating through the loop circuit. Thus, it is possible to synthesize the musical tones containing the noises of which characteristics may correspond to those of the noises actually generated by the noise-generating mechanism of the wind instrument.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings:

FIG. 3 is a block diagram showing an electric configuration of the performance-input device;

FIG. 5 is a graph showing a characteristic of a non-linear function B shown in FIG. 4;

FIG. 7 is a graph showing a characteristic of a non-linear function A shown in FIG. 4;

FIGS. 8A, 8B illustrate the construction of the mouthpiece and reed of the wind instrument;

FIG. 13A is a circuit diagram showing a modified example of a main part of the noise generating portion, while

DESCRIPTION OF THE PREFERRED EMBODIMENTS

[A]First Embodiment

Figure 1:
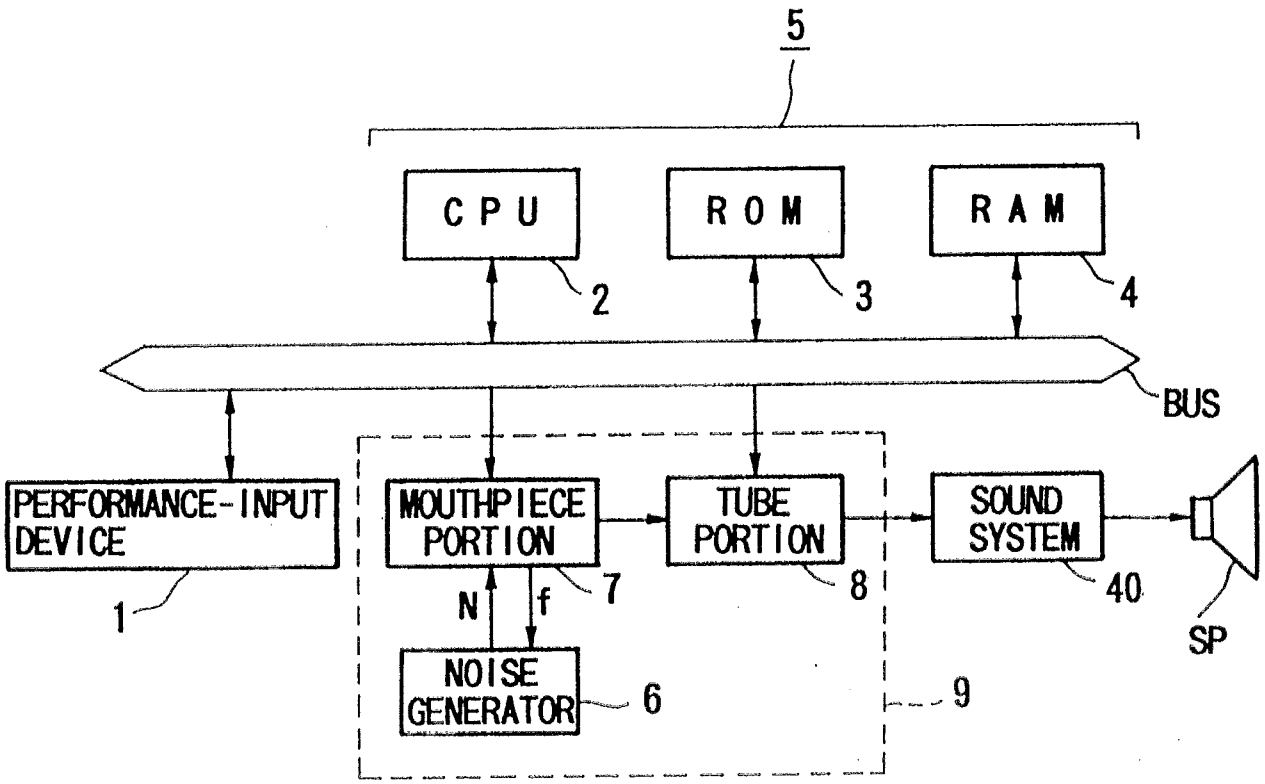
FIG. 1 is a block diagram showing the whole configuration of a musical tone synthesizing apparatus according to a first embodiment of the present invention.

FIG. 1 is a block diagram showing the whole configuration of the musical tone synthesizing apparatus according to a first embodiment of the present invention. In FIG. 1, 1 designates a performance-input device having a clarinet-like shape, which creates several kinds of signals representing pitch information, tone-volume information and the like in response to the performing operations made by a performer.

Figure 2:
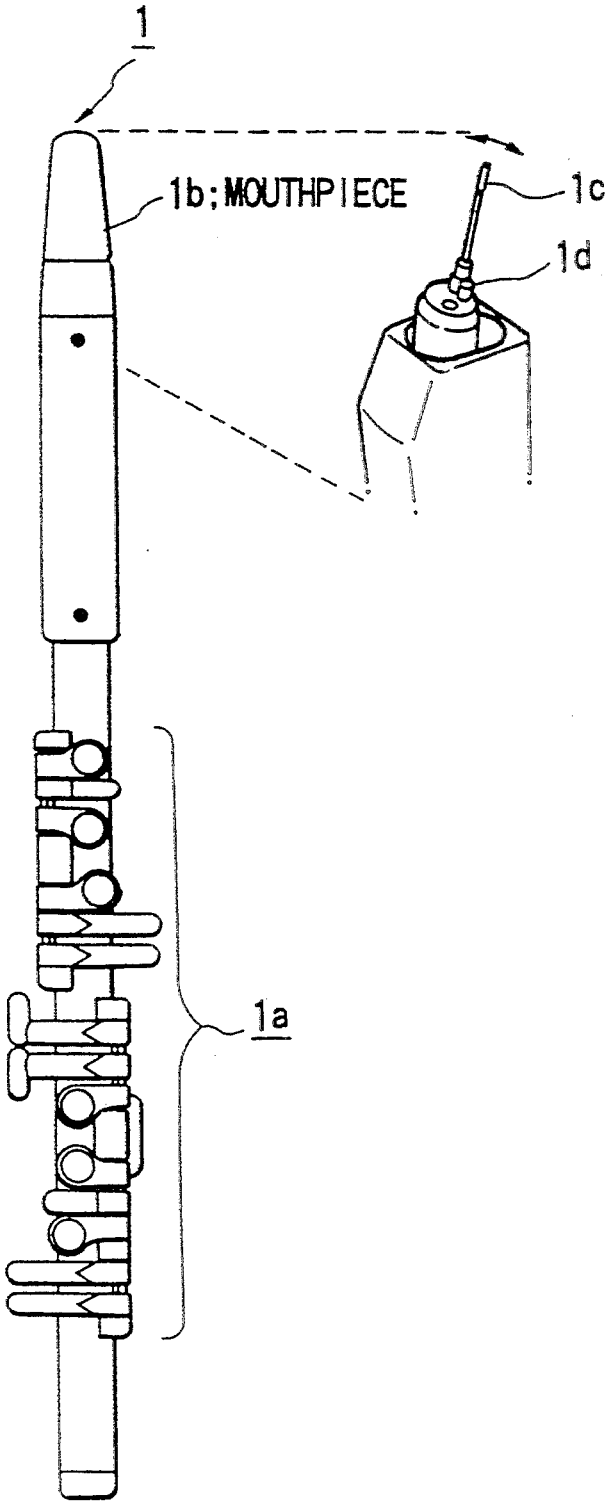
FIG. 2 illustrates an appearance of a performance-input device 1 shown in FIG. 1.

Now, detailed description will be given with respect to the appearance and construction of this performance-input device 1 by referring to FIGS. 2, 3. FIG. 2 shows an example of the appearance of the performance-input device 1. Herein, 1*a* designates key switches, while 1*b* designates a mouthpiece in which, as shown by the enlarged view, there are provided a cantilever 1*c* and a pressure sensor 1*d*. The cantilever 1*c* is provided to detect the pressure (usually denoted to as "Embouchure pressure") which is applied to the reed when the performer holds the mouthpiece 1*b* in his mouth. On the other hand, the pressure sensor 1*d* detects the blowing pressure of the breath which is blowing into the mouthpiece 1*b* by the performer.

The performance-input device 1 also contains a micro-computer 1*e* as shown in FIG. 3. This micro-computer 1*e* converts signals, outputted from the key switches 1*a*, cantilever 1*c* and pressure sensor 1*d*, into digital data. Then, the scaling operation is performed on the digital data so as to produce several kinds of data, which are outputted from the performance-input device 1 to another micro-computer 5 shown in FIG. 1. Among these data, key-on data Kon or key-off data Koff is produced by the result of judging whether or not the output signal of the pressure sensor 1*d* exceeds the predetermined level.

Meanwhile, cent-value data C representing the tone pitch is created on the basis of a keycode which is produced responsive to the operation applied to the key switch 1*a*. On the other hand, breath pressure data P is created on the basis of the output signal of the pressure sensor 1*d*. This data P will be modified by embouchure data E, obtained from the cantilever 1*c*, such that the blowing manner will be well simulated.

Next, description will be given with respect to the other elements shown in FIG. 1. Herein, 6 designates a noise generator generating noise data N which is used for reproducing the foregoing sub-tone and breath-leak sound. This noise data N is used for simulating the turbulent-flow phenomenon which is occurred at the gap between the mouthpiece and reed. Incidentally, this turbulent-flow phenomenon will be described later in detail, while the detailed construction of the noise generator 6 will be also described later. In FIG. 1, 7 designates a mouthpiece portion which simulates the operations of the mouthpiece and reed of the wind instrument. Further, 8 designates a tube portion which simulates the air-transmission characteristic of the tube of the wind instrument. These circuit elements 6 to 8 are assembled together to configure a musical tone synthesizing circuit 9.

Next, detailed description will be given with respect to the musical tone synthesizing circuit 9 by referring to FIG. 4, wherein parts identical to those shown in FIG. 1 will be designated by the same numerals. This musical tone synthesizing circuit 9 contains the mouthpiece portion 7 and the tube portion 8 which further contains a Junction 22 and a tube simulation circuit 20. The mouthpiece portion 7 is configured by a subtracter 13, adders 16, 33, multipliers 31, 32, 34, non-linear circuits 11*a*, 11*b* and filters 30*a*, 30*b*, so that it is designed to simulate the vibrations occurred at the mouthpiece and reed of the wind instrument. The junction 22 consists of adders 22*a*, 22*b*. The tube simulation circuit 20 is designed to simulate the operations of the resonance tube of the wind instrument, and the detailed configuration thereof will be described later.

In the above-mentioned Junction 22, the adder 22*a* adds the output data of the multiplier 34 and tube simulation circuit 20 together so as to output the addition result thereof to the tube simulation circuit 20, while another adder 22*b* adds the output data of the tube simulation circuit 20 and adder 22*a* together so as to output the addition result thereof to the subtracter 13 via the filter 30*b*. Thus, it is possible to simulate the scattering manner of the air-pressure wave at the terminal portion between the mouthpiece and resonance tube. Due to the provision of the filter 30*b*, it is possible to embody the frequency characteristic of the mouthpiece, and it is also possible to prevent the frequency of the signal circulating between the excitation circuit 10 and tube simulation circuit 20 from being remarkably increased higher than the specific frequency.

Meanwhile, the subtracter 13 receives the breath pressure data P corresponding to the breath-blowing pressure, and feedback data outputted from the filter 30*b*. This feedback data corresponds to the air-pressure wave which is reflected by the middle portion or end terminal of the resonance tube and then returned back to the mouthpiece. Thus, the subtracter 13 outputs the data corresponding to the air pressure applied to the gap between the mouthpiece and reed, and this data is supplied to the filter 30*a*. The filter 30*a* is provided to simulate the operations of the reed. In short, this filter 30*a* performs a frequency-band restriction on the input data thereof. Because, when varying the reed pressure, the inertia of the reed may produce a delay to the reed displacement, however, if the reed-pressure-variation frequency is relatively high, the reed cannot respond to such reed-pressure variation anymore.

In order to simulate the responding characteristic of the reed by which the displacement of the reed responds to the reed-pressure variation, the filter 30*a* performs the frequency-band restriction as described above. Further, this filter 30*a* also functions to give an initial displacement for the reed operation in response to the foregoing embouchure data E.

The output data P1 of the filter 30*a* is added with the embouchure data E as the offset value by the adder 16, so that the addition result, i.e., data P2, corresponds to the pressure actually applied to the reed of the wind instrument. This data P2 is supplied to the non-linear circuit 11*a*, wherein it is subjected to the table conversion by the non-linear function A (see FIG. 7) stored in the non-linear circuit 11*a*. Due to the table conversion made by the non-linear circuit 11*a*, the data P2 is converted into data L which corresponds to a gap distance between the mouthpiece and reed. Then, the multiplier 31 multiplies this data L by a constant b representing the width (or length) of the reed. Due to this multiplication made by the multiplier 31, it is possible to obtain data S corresponding to the gap area between the mouthpiece and reed.

In general, the air-flow velocity at the gap between the mouthpiece and reed may be varied responsive to the air pressure, however, it may be saturated at certain velocity. FIG. 5 is a graph showing an example of the saturation characteristic of air-flow velocity. The information representing this saturation characteristic is stored in the non-linear circuit 11*b* as the non-linear function B. This non-linear circuit 11*b* inputs the output data of the subtracter 13 representing the air pressure at the gap between the mouthpiece and reed. Thus, the non-linear circuit 11*b* performs the table conversion on this data so as to compute the data representing the air-flow velocity at the saturated state. Then, the multiplier 32 multiplies the output data of the non-linear circuit 11*b* by the foregoing data S. As a result, it is possible to obtain data f representing the volume-flow velocity of air at the gap.

Next, description will be given with respect to the noise generator 50 which is configured on the basis of the result of the analysis which is made on the noise-generating mechanism of the actual wind instrument as correctly as possible. In the following description, we will explain about the theoretical background for the simulation of the noise-generating mechanism and the detailed configuration of the noise generator 50 based on the following theory.

① Theoretical Background

In general, by use of the flow velocity "U" of the viscous fluid, representative length "L" and kinematic viscosity of the fluid, the Reynolds number R (dimensionless amount) in the motion of the viscous fluid containing the turbulent flow can be represented as follows: $R=UL/\nu$. Among the flow velocity U, volume-flow velocity f and the sectional area S through which the fluid is to be passing, there is established a relationship as follows: $U=f/S$. By use of this relationship, the above-mentioned Reynolds number R can be rewritten to the following equation (1).

$$R=(f/S)*L/\nu \tag{1}$$

Herein, the Reynolds number R is a value representing the flowing state of the fluid. It is generally known that the laminar flow is occurred in the fluid when this value is less than "2000" (dimensionless value), while the turbulent flow is occurred in the fluid when this value is more than "2000". According to the Kolmogoroff's Law, as this Reynolds number R becomes larger, the spectral distribution of the turbulent flow may contain lower frequency components, so that the direct-flow energy will be approximately proportional to the Reynolds number R. For this reason, by performing the filtering operation, corresponding to the Reynolds number R, on a white-noise signal WN having a uniform spectral distribution, it is possible to simulate the turbulent flow having a desirable spectral distribution.

Next, description will be given with respect to an example of the single-reed instrument, such as the clarinet, having the structure as shown by FIGS. 8A, 8B. In this instrument wherein both of the reed width b and the opening distance of the gap between the mouthpiece and reed are set, the opening area S can be represented by "bζ". Herein, the reed width b is a fixed value, while the opening distance can be replaced by the representative length L. Therefore, the foregoing equation (1) can be rewritten to the following equation (2).

$$R=\{f/(bL)\}*L/\nu=f/(b\nu) \tag{2}$$

In case of the turbulent flow, the Reynolds number R can be represented by the following equation (3) by using the energy dissipation rate e as the representative parameter. The foregoing Kolmogoroff's Law defines the energy spectrum E(k) with respect to the wave number k of the fluid which is in the turbulent-flow state having an extremely large Reynolds number R as follows:

$$\begin{aligned} E(k)/(\epsilon*\nu^5)^{1/4} &= A*(\eta\, k)^{-3/5}*F(\eta\, k) \\ &= F'(\eta\, k) \end{aligned} \tag{4}$$

In the equation (4), "$\epsilon$" indicates the energy dissipation rate; "$\nu$" indicates the kinematic viscosity rate; "$\eta$" indicates the Kolmogoroff length (where $f(\equiv(\nu^3/\epsilon)^{\frac{1}{4}})$; "A" indicates the dimensionless constant; $F(\eta k)$ and $F'(\eta k)$ are dimensionless functions regarding to the product $\eta k$.

When performing a normalization using $(\epsilon*\nu^5)^{\frac{1}{4}}$ on the curve represented by the function of the equation (4) in a graph wherein the horizontal axis represents the product $\eta k$ and vertical axis represents the energy spectrum E(k), in other words, when plotting a curve with respect to $E(k)/(\epsilon*\nu^5)^{\frac{1}{4}}$, it is possible to obtain a smooth curve represented by $F'(\eta k)$. However, this curve of $F'(\eta k)$ is obtained by use of the extremely large Reynolds number R. In contrast, when the Reynolds number R is relatively small, it is known that the curve corresponding to the saturation characteristic as shown in FIG. 9 is emerged.

Figure 9:
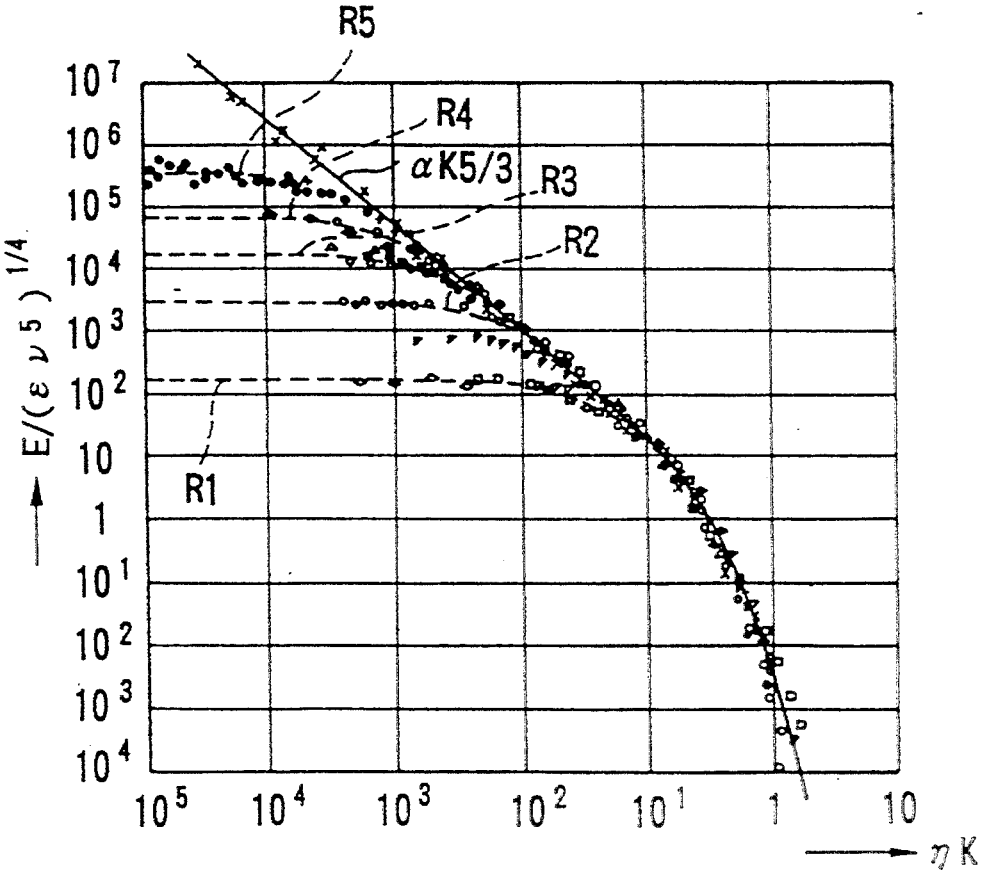
FIG. 9 is a graph showing a saturation characteristic for Reynolds number R.

In the above-mentioned saturation characteristics as shown in FIG. 9, several kinds of curves are plotted with respect to some Reynolds numbers R1 to R4 respectively. These curves show that each of the energy-saturation levels $Esat/(\epsilon*\nu^5)^{\frac{1}{4}}$ (see vertical axis of FIG. 9) may be approximately identical to each of the Reynolds numbers R1 to R4. Thus, it is possible to obtain a relationship of "$Esat/(\epsilon*\nu^5)^{\frac{1}{4}}$ R", from which the energy-saturation level Esat can be represented by the following equation (5).

$$\begin{aligned} Esat &= R*(\epsilon*\nu^5)^{1/4} \\ &= \{f/(b\nu)\}*\{(f/b)^3\, L^{-4}*\nu^5\}^{1/4} \\ &= \nu^{1/4}\, b^{-7/4}*\,|f|^{7/4}/L \end{aligned} \tag{5}$$

Incidentally, it is also known that the amplitude-saturation level Asat, corresponding to the above-mentioned energy-saturation level, is proportional to the square root of the energy E. In the equation (5), both of the parameter $\nu$ and b are constants, therefore, the amplitude-saturation level Asat can be represented by the following equation (6).

$$Asat=Ap*|f|^{7/8}/L^{\frac{1}{2}} \tag{6}$$

where Ap is a proportional constant.

It is observed from FIG. 9 that the curve representing the saturation characteristic may be formed along with the curve of $k^{-3/5}$. Both of the axes of FIG. 9 represent logarithmic values, thus, the curve can be subjected to the linear approximation. In such linear approximation, the inclination of the linear curve is around −5 dB/oct, which indicates that as the frequency is doubled, the energy is attenuated by 5 dB. This also indicates that the attenuation characteristic of the curve can be well matched with the approximation of the primary attenuation characteristic where the attenuation rate is at −6 dB/oct.

In the characteristic as shown in FIG. 9, the cut-off value $\eta$ kc1 which is obtained by varying the Reynolds number R can be set at the value $\eta k$ at which the energy level is reduced to the half of the reference energy level in the predetermined frequency-band-passing range. Such cut-off value $\eta$kc1 can be represented by the following equation:

$$\eta kc1 \rightleftarrows (2R)*\exp(-\tfrac{1}{2}) \tag{7}$$

Further, the spectral characteristic of FIG. 9 originally relates to that of the spatial frequency, however, it may be approximately treated as the spectral characteristic of the normal frequency. Thus, there is established a relationship, as defined by the following equation (8), among the value kc1, cutoff frequency fc1 and sound velocity c.

$$kc1=2\pi fc1/c \tag{8}$$

By putting the relationships as defined by the foregoing equations (2), (3), (8) in the equation (7), it is possible to obtain the following equation (9) defining the cut-off frequency fc1:

$$fc1=(c/\pi)*(\nu b)^{-h}*(f^{h}/L) \quad (9)$$

where $h=(182)-(1/\sqrt{2})$.

Figure 10A:
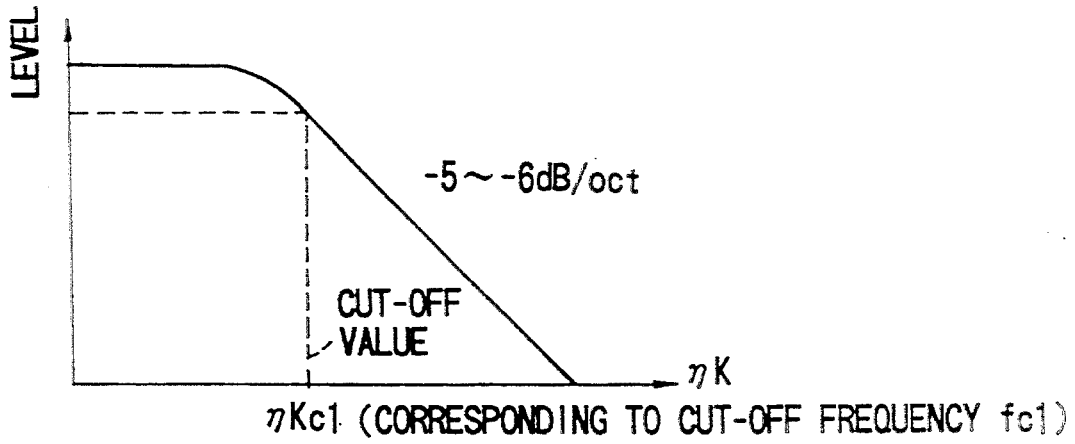
FIGS. 10A, 10B, 10C are graphs which are used for explaining the approximation technique of the saturation characteristic shown in FIG. 9.
Figure 10B:
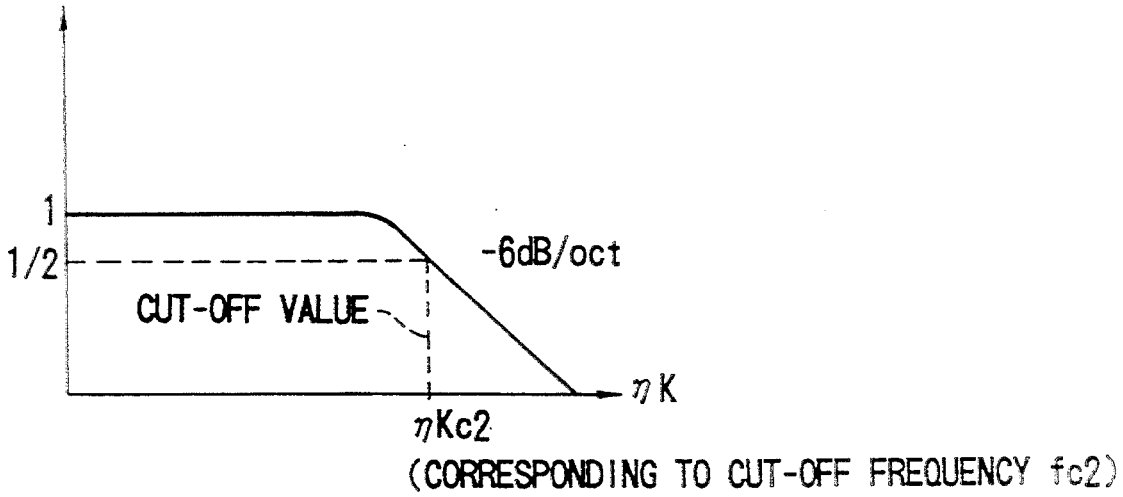
Figure 10C:
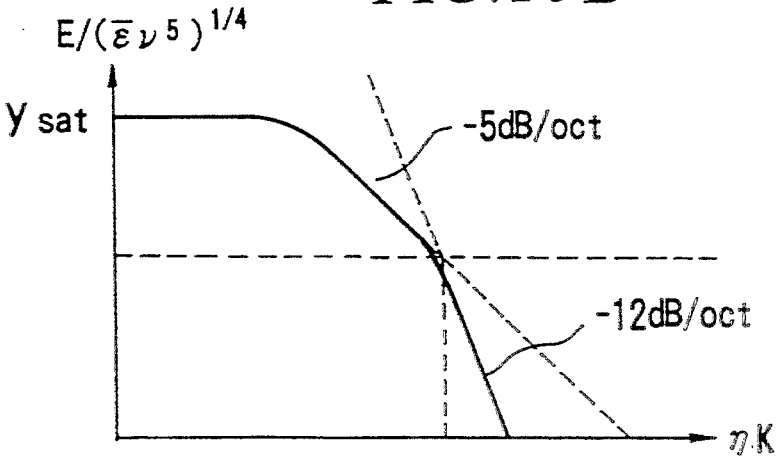

Further, it is observed from FIG. 9 that when the product $\eta k$ exceeds the predetermined value, the linear-approximate curve corresponding to the characteristic of FIG. 9 may have an attenuation inclination of "−12 dB/oct". In short, the curve of the saturation characteristic can be divided into two areas, wherein one-area curve has an attenuation of "−5 dB/oct", while second-area curve has an attenuation of "−12 dB/oct". Thus, the saturation characteristic as shown in FIG. 9 can be approximately embodied by the convolution between the primary low-pass-filter characteristic A having a transfer function as shown by FIG. 10A and another primary low-pass-filter characteristic B having a transfer function as shown by FIG. 10B. The convolution result (or product) between these two characteristics A, B will be represented by the curve as shown in FIG. 10C which may correspond to the approximation result of the saturation characteristic of FIG. 9.

In the meantime, the cut-off frequency fc2 of the low-pass-filter characteristic B can be obtained by the following computation. More specifically, two straight lines each having a different inclination are drawn with respect to the curve shown in FIG. 9, thus obtaining a point of intersection between them, and reading a horizontal-axis value "Xtrans" from this point. When setting kc2 as the wave number corresponding to the frequency fc2, the following equation (10) can be obtained.

$$\eta kc2=(\nu^3/\epsilon)^{\frac{1}{2}}*2\pi fc2/c=Xtrans \quad (10)$$

By expanding this equation (10), it is possible to obtain the following equation (11) defining the cut-off frequency fc2 of the low-pass-filter characteristic B.

$$fc2=\{c/(\pi Xtrans)\}*(\nu b)^{-182}*(f^{\frac{1}{2}}/L) \quad (11)$$

② Configuration of Noise Generator 50

Figure 11:
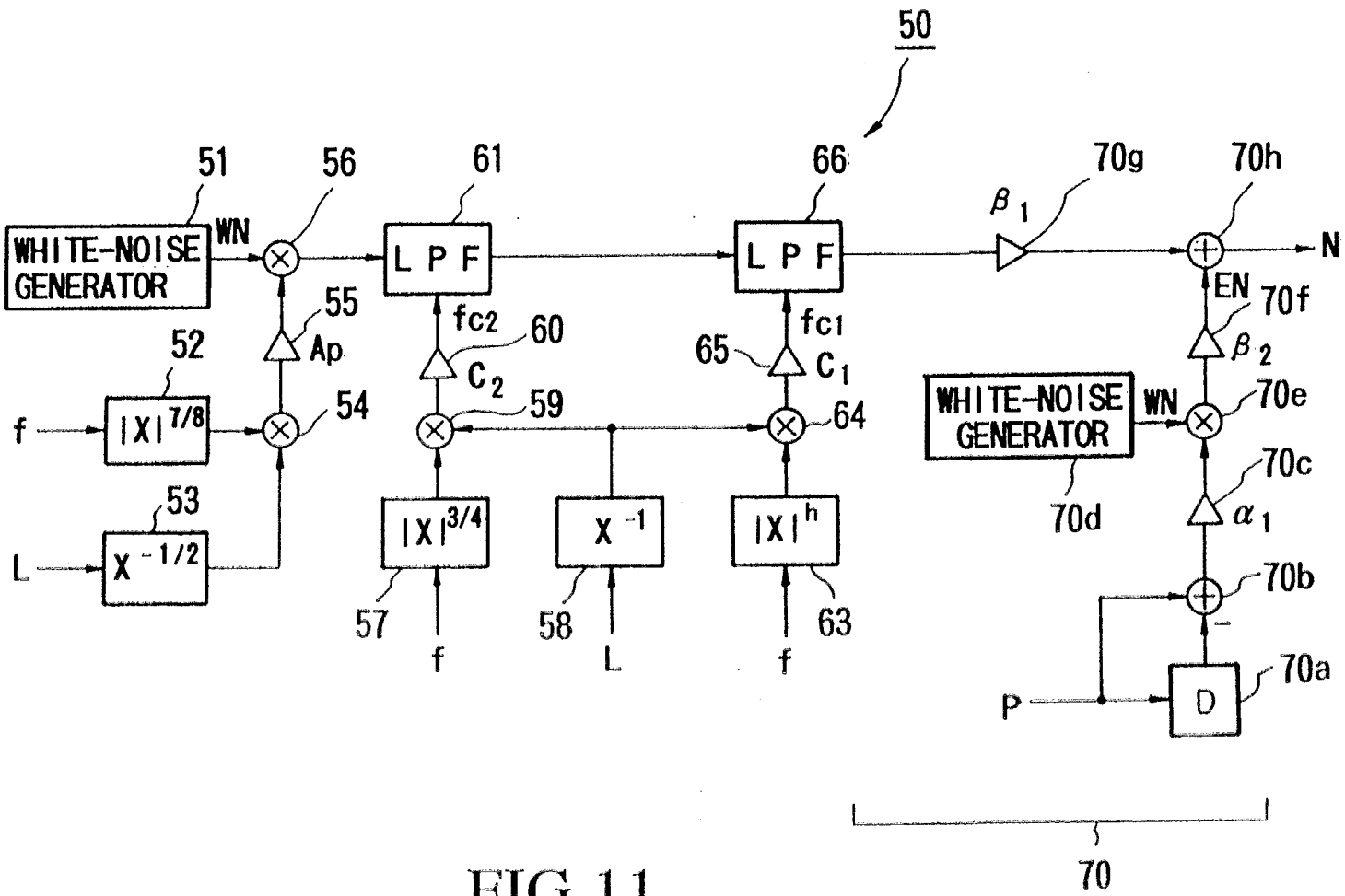
FIG. 11 is a block diagram showing a detailed configuration of a noise generating portion of the first embodiment.

Next, description will be given with respect to the detailed configuration of the noise generator 50, simulating the turbulent-flow phenomenon at the gap between the mouthpiece and reed, by use of the foregoing low-pass-filter characteristics A, B in conjunction with FIG. 11. In FIG. 11, 51 designates a white-noise generator which generates a white-noise signal WN. 52 designates an operation circuit which raises the absolute value of the input signal (i.e., x) to the "$-\frac{1}{2}$" power. This operation circuit 52 receives the data f representing the volume-flow velocity at the gap between the mouthpiece and reed.

In addition, 53 designates another operation circuit which raises the input signal (i.e., x) to the "-1/2" power. This operation circuit 53 receives the data L representing the gap between the mouthpiece and reed. 54 designates a multiplier which multiplies the outputs of the operation circuits 52, 53 together. 55 designates a coefficient multiplier which multiplies the input signal thereof by a coefficient Ap. The output of this multiplier 55 corresponds to the amplitude-saturation level Asat which is represented by the foregoing equation (6). Further, 56 designates a multiplier which multiplies the white-noise signal WN and amplitude-saturation level Asat together. Thus, the multiplier 56 can output the white-noise signal of which level corresponds to the amplitude-saturation level Asat.

Furthermore, 57 designates an operation circuit which raises the data f to the "$\frac{3}{2}$" power; 58 designates an operation circuit which outputs the inverse value "1/L" of the data L; and 59 designates a multiplier which multiplies the outputs of these operation circuits 57, 58 together. 60 designates a coefficient multiplier which multiplies the output of the multiplier 59 by a coefficient C2. These circuit elements 57 to 60 correspond to the operation of the foregoing equation (11), so that they output the data corresponding to the cut-off frequency fc2. Incidentally, the coefficient C2 is set corresponding to "$c/(\pi Xtrans)$" in the equation (11). 61 designates a low-pass filter which forms an attenuation characteristic (see FIG. 10B) having the cut-off frequency fc2 in response to the output signal of the coefficient multiplier 60, so that the filtering operation is performed on the output signal of the multiplier 56 in accordance with this attenuation characteristic.

Meanwhile, 63 designates an operation circuit which raises the data f to the "h" power, while 64 designates a multiplier which multiplies the outputs of the operation circuits 58, 63 together. 65 designates a coefficient multiplier which multiplies the output of the multiplier 64 by a coefficient C1. These circuit elements 63 to 65 correspond to the operation of the foregoing equation (9), so that they output the data corresponding to the cut-off frequency fc1. Incidentally, the coefficient C1 is set corresponding to "$c/\pi$" in the equation (9). Further, 66 designates a low-pass filter which forms the attenuation characteristic (see FIG. 10A) having the cut-off frequency fc1 in response to the output signal of the coefficient multiplier 65, so that the filtering operation is performed on the white-noise signal WN passing through the low-pass filter 61 in accordance with this attenuation characteristic.

According to the operations of the above-mentioned circuit configuration, the filtering operations corresponding to the Reynolds number R are performed on the white-noise signal WN having a uniform spectral distribution, thus, this circuit portion can approximately simulate the behavior of the turbulent flow in the tube having a desirable spectral distribution. In this embodiment, two primary low-pass filters are merely connected in series to simulate the turbulent flow. Such circuit configuration having a simple structure is designed on the basis of the theoretical background with accuracy, therefore, it is possible to simulate the turbulent-flow phenomenon with accuracy.

In the actual wind instrument, there is known a further complicated noise-generating mechanism such as the "edge-tone phenomenon" which is emerged in the attack portion of the envelope waveform of the musical tone to be produced. Thus, a noise generating circuit 70 simulating such phenomenon is further connected with the noise generator 50. In the following description, the noise behavior at the musical-tone-generation timing is described first, and then, the configuration of the noise generating circuit 70 will be described later.

Figure 12A:
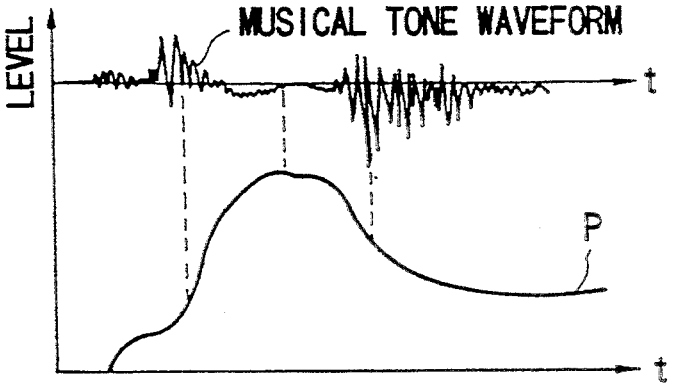
FIGS. 12A, 12B are graphs showing waveforms which are used for explaining operations of the noise generating portion.
Figure 12B:
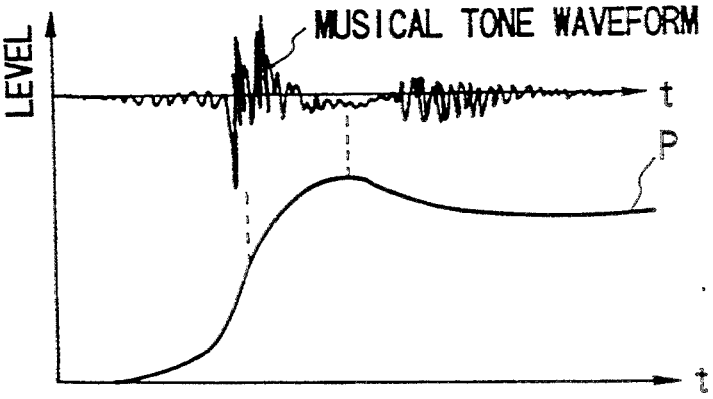

Each of FIGS. 12A, 12B shows a variation of the data P and the corresponding musical tone waveform at the musical-tone-generation timing, i.e., at the attack portion of the musical tone waveform which is produced by playing the saxophone. As described before, the data P represents the breath pressure applied to the wind instrument by the performer. It is presumed from these graphs that the envelope waveform of the noise at its attack portion may be formed proportional to the waveform representing the differentiation result of the data P.

Next, detailed description will be given with respect to the noise generating circuit 70 by referring to FIG. 11 again. In FIG. 11, 70*a* designates a differentiation circuit which performs a differentiation on its input signal. Herein, the differentiation circuit 70*a* receives the foregoing data P representing the breath pressure which is applied to the wind instrument when blowing a breath into the mouthpiece by the performer. 70*b* designates a subtracter which subtracts the differentiation result of the differentiation circuit 70*a* from the data P. 70*c* designates a coefficient multiplier which multiplies its input signal by a coefficient $\alpha$, while 70*d* designates a white-noise generator which generates the aforementioned white-noise signal WN. 70*e* designates a multiplier which multiplies the white-noise signal WN and the output of the coefficient multiplier 70*c* together.

Meanwhile, 70*g*, 70*f* designate coefficient multipliers having coefficients $\beta 1$, $\beta 2$ respectively. Herein, the coefficient multiplier 70*g* multiplies the output of the low-pass filter 66 by the coefficient $\beta 1$, while another coefficient multiplier 70*f* multiplies the output of the multiplier 70*e* by the coefficient $\beta 2$ so as to output its multiplication result as an output EV. 70h designates an adder which adds the outputs of the coefficient multipliers 70*g*, 70*f* together, so as to output the addition result thereof as noise data N. These circuit elements 70*a* to 70*h* are designed to simulate the behavior of the noise of which level is reduced as the oscillation frequency of the musical tone becomes constant. Incidentally, the above-mentioned coefficients $\alpha$, $\beta 1$, $\beta 2$ are respectively set such that the noise behavior can be well simulated.

Figure 13A:
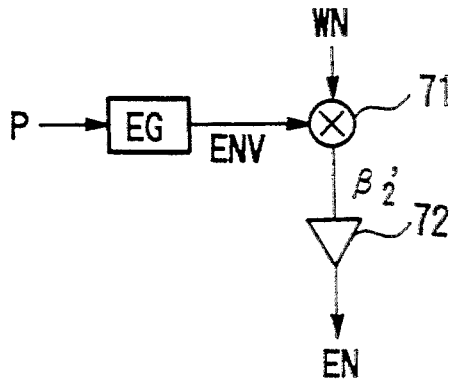
Figure 13B:
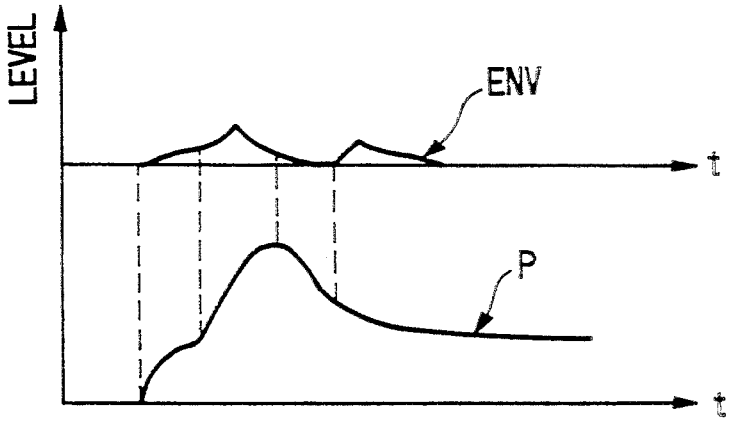
FIG. 13B is a graph showing the breath pressure P and envelope ENV.

Incidentally, the circuit portion corresponding to the elements 70*a* to 70*f* within the noise generating circuit 70 shown in FIG. 11 can be modified as shown in FIG. 13A. Herein, an envelope generator EG generates an envelope signal ENV of which level is controlled by the breath-pressure signal P. Then, the amplitude control is performed by multiplying the envelope signal ENV and white-noise signal WN together in a multiplier 71. Another multiplier 72 multiplies the output of the multiplier 71 by a coefficient $\beta 2'$ so as to obtain the output EN of which level is determined by the coefficient $\beta 2'$. FIG. 13B shows an example of the relationship between the breath-pressure signal P and envelope signal ENV.

Figure 4:
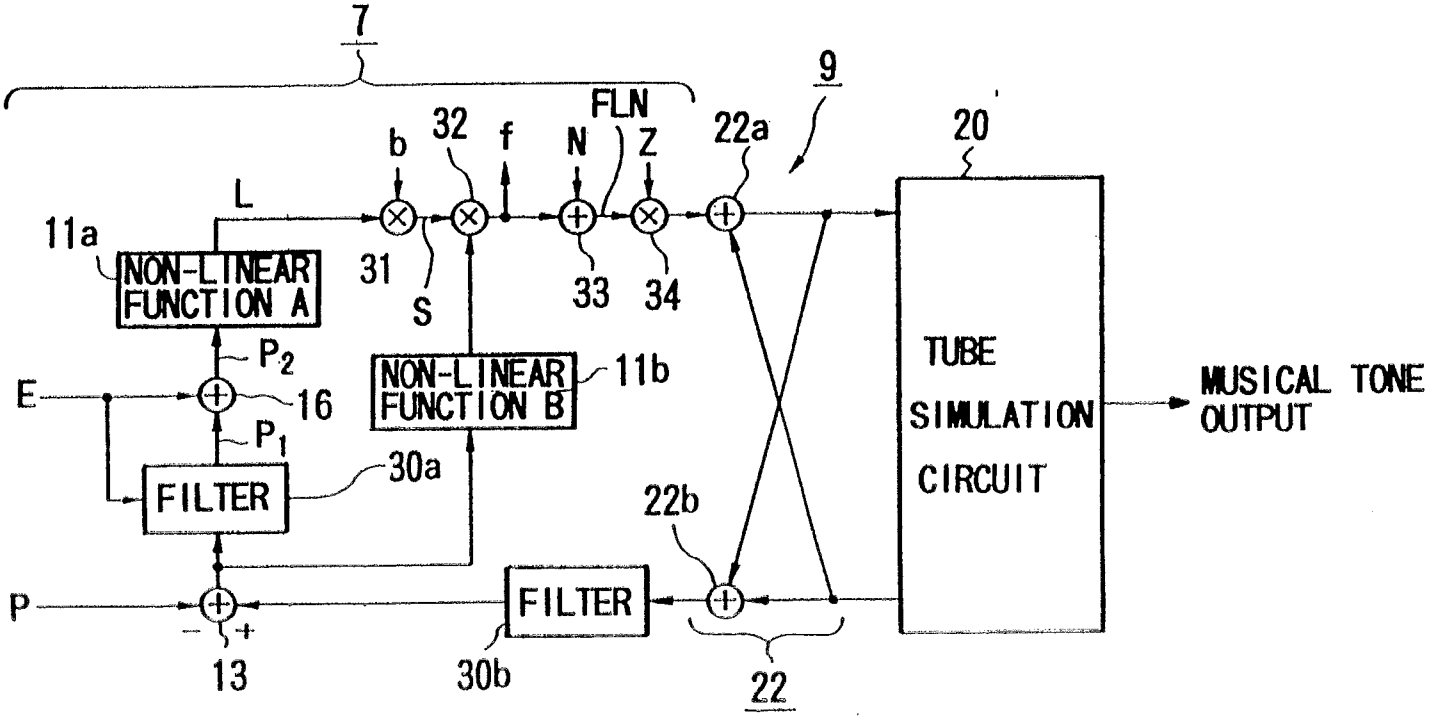
FIG. 4 is a block diagram showing a detailed configuration of a musical tone synthesizing circuit 9 shown in FIG. 1.

Next, the above-mentioned noise data N is added to the data f by the adder 33 (see FIG. 4). As a result, the adder 33 outputs data FLN which incorporates the offset value corresponding to the turbulent flow. Then, the multiplier 34 multiplies this data FLN by a constant Z. This constant Z is determined responsive to the diameter of the tube in the vicinity of the reed-attaching portion of the wind instrument, it may correspond to the resistance or impedance to the air flow. This multiplication performed by the multiplier 34 offers the data which corresponds to the air pressure within the inside of the tube, and this data is supplied to the tube simulation circuit 20 via the adder 22*a* of the junction 22. Then, the output data of the tube simulation circuit 20 is transmitted backward to the junction 22 and filter 30*b*, from which it is supplied to the subtracter 13. Thus, the aforementioned signal processing will be performed again.

Figure 6:
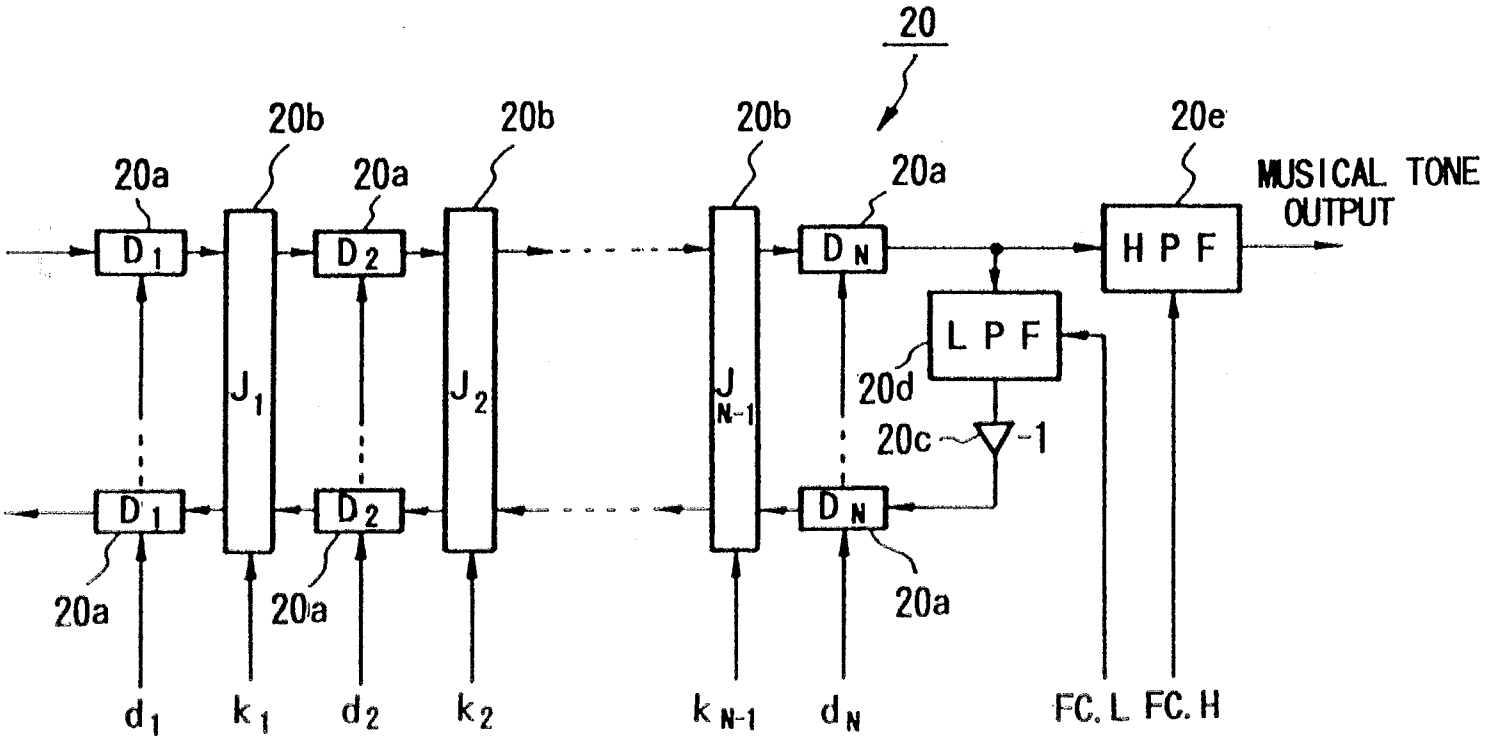
FIG. 6 is a block diagram showing a détailed configuration of a tube simulation circuit 20 shown in FIG. 4.

Next, description will be given with respect to the tube simulation circuit 20 by referring to FIG. 6. In FIG. 6, numerals 20*a* designate delay circuits each constructed by the shift registers, so that they are designed to simulate the propagation delays of the air-pressure wave in the resonance tube. Numerals 20*b* designate Junctions each provided between each pair of the delay circuits 20*a*. 20*c* designates an inverter which simulates the reflection of the air-pressure wave at the end terminal of the resonance tube. 20*d* designates a low-pass filter (LPF), while 20*e* designates a high-pass filter (HPF).

In the above-mentioned configuration as shown in FIG. 6, the output signal of the rightmost delay circuit 20*a* is delivered to the LPF 20*d* and HPF 20*e*, wherein the lower-frequency component filtered by the LPF 20*d* represents the air-pressure wave which is reflected by the end terminal of the tube, while the higher-frequency component filtered by the HPF 20*e* is used for the synthesis of the musical tone. The reason why the HPF 20*e* is provided is that the acoustic-radiation-impedance characteristic of the wind instrument can be embodied by the high-pass-filter characteristic. Incidentally, delay amounts d1 to dn, junction coefficients k1 to kn−1 and filter coefficients FCL, FCH are obtained from the computation results of the keycodes, embouchure data E and breath-pressure data P, wherein such computations are executed by the CPU 2.

In the musical tone synthesizing circuit 9, the noise data N for the turbulent flow which responds to both of the data f and data N (wherein the data f corresponds to the volume-flow velocity of the air flow passing through the gap between the mouthpiece and reed, while the data S corresponds to the gap area between them) is given as the offset value. Therefore, this circuit 9 can perform the signal processings which match with the noise-generating mechanism of t[he actual wind instrument. Thereafter, the musical tone signal obtained from the result of the above-mentioned signal processings is supplied to a sound system (see FIG. 1) 40 which performs a signal processing so that a speaker SP will produce the musical tone. Thus, it is possible to accurately reproduce the nose-applying effect employed in the actual performance of the wind instrument, in other words, it is possible to accurately regenerate the breath-leak sound or subtone in which by strongly blowing the breath into the wind instrument, the noises are emphasized when the air-flow velocity at the gap between the mouthpiece and reed reaches the saturation state.

[B]Second Embodiment

Next, description will be given with respect to the second embodiment of the present invention in conjunction with FIG. 14. In the foregoing first embodiment, the noise generator 50 is mainly used for simulating the noise-generating mechanism of the actual wind instrument, so that this noise generator 50 has a complicated configuration which is designed on the basis of the accurate analysis of the noise-generating mechanism.

When carefully examining the cut-off frequency fc1 of the low-pass filter of the noise generator 50, the data f representing the opening distance of the gap between the mouthpiece and reed can be represented by the product "v*bL" where "v" designates the air-flow velocity [cm/sec], while "bL" is equal to the slit area "S". Thus, the cut-off frequency fc1 as defined by the foregoing equation (9) can be further expanded as follows:

$$\begin{aligned} fc1 &= (c/\pi)*(\nu\, b)^{-h}*(f^h/L) \\ &= (c/\pi)*(\nu\, b)^{-h}*\{(\nu bL)^h/L\} \\ &= (c/\pi)*\nu^{-h}*(\nu^h/L^{1-h}) \end{aligned} \tag{12}$$

In the above-mentioned equation (12), parameters c, $\nu$, b, h are constants depending on the reed and mouthpiece of the clarinet. For example, c is equal to 34000 [$cm^2$/sec], $\nu$ (kinematic viscosity) is equal to 0.15 [$cm^2$/sec] and $h=(\frac{3}{4})-(1/\sqrt{2})$ 0.0429. By using these values, the equation (12) can be rewritten as follows: "$fc1 \rightleftarrows 1.174*10^4*(v^{0.0429}/L^{0.9571})$". Herein, L represents the opening distance of the gap (or slit) between the mouthpiece and reed, so that it belongs to a range of $0<L\leqq 0.071$ [cm]. When $L=0.071$, the cut-off frequency fc1 is at the minimum value, i.e., $fc1L \rightleftarrows 1.476*10^5*v^{0.0429}$.

Under consideration of the maximum range of "v" [cm/sec] in the woodwind instrument, i.e., $0<v<3000$, the cut-off frequency fc1 in almost part of one-period waveform may be considerably higher than the audio frequency. Thus, two low-pass filters 61, 66 respectively having the cut-off frequencies fc1, fc2 (where fc1<fc2) can be omitted from the noise generator 50, so that the configuration of the noise generator 50 can be simplified.

The configuration of the noise generator 50 can be further simplified as follows. The foregoing equation (6) defines "$Asat=Ap*|f|^{7/8}/L^{\frac{1}{2}}$ (where Ap is a proportional constant). Herein, by using the approximation of "$|f|^{7/8}\equiv f$", the equation (6) can be simplified as follows:

$$Asat=Ap*f/L^{\frac{1}{2}} \tag{13}$$

Further, it is possible to omit the nose generating circuit 70 from the configuration of the noise generator 50, wherein as described before, this noise generating circuit 70 is provided to generate the noise of which level is proportional to the level of the waveform corresponding to the differentiation result of the breath-pressure data P. In this case, the equation of the volume-flow velocity data FLN which incorporates the data corresponding to the turbulent flow to be computed can be simplified as follows:

$$\begin{aligned} FLN &= WN*Ap*f*L^{\frac{1}{2}}+f \\ &= f*(1+WN*Ap*L^{\frac{1}{2}}) \end{aligned} \tag{14}$$

Figure 14:
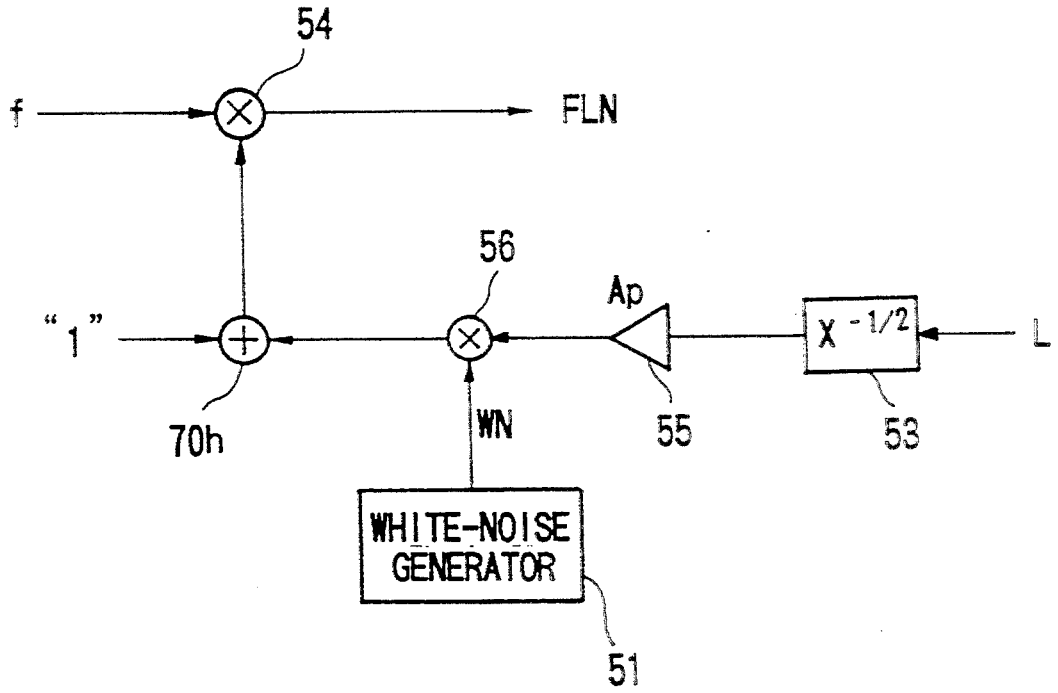
FIG. 14 is a block diagram showing the noise generating portion according to a second embodiment of the present invention.
Figure 15:
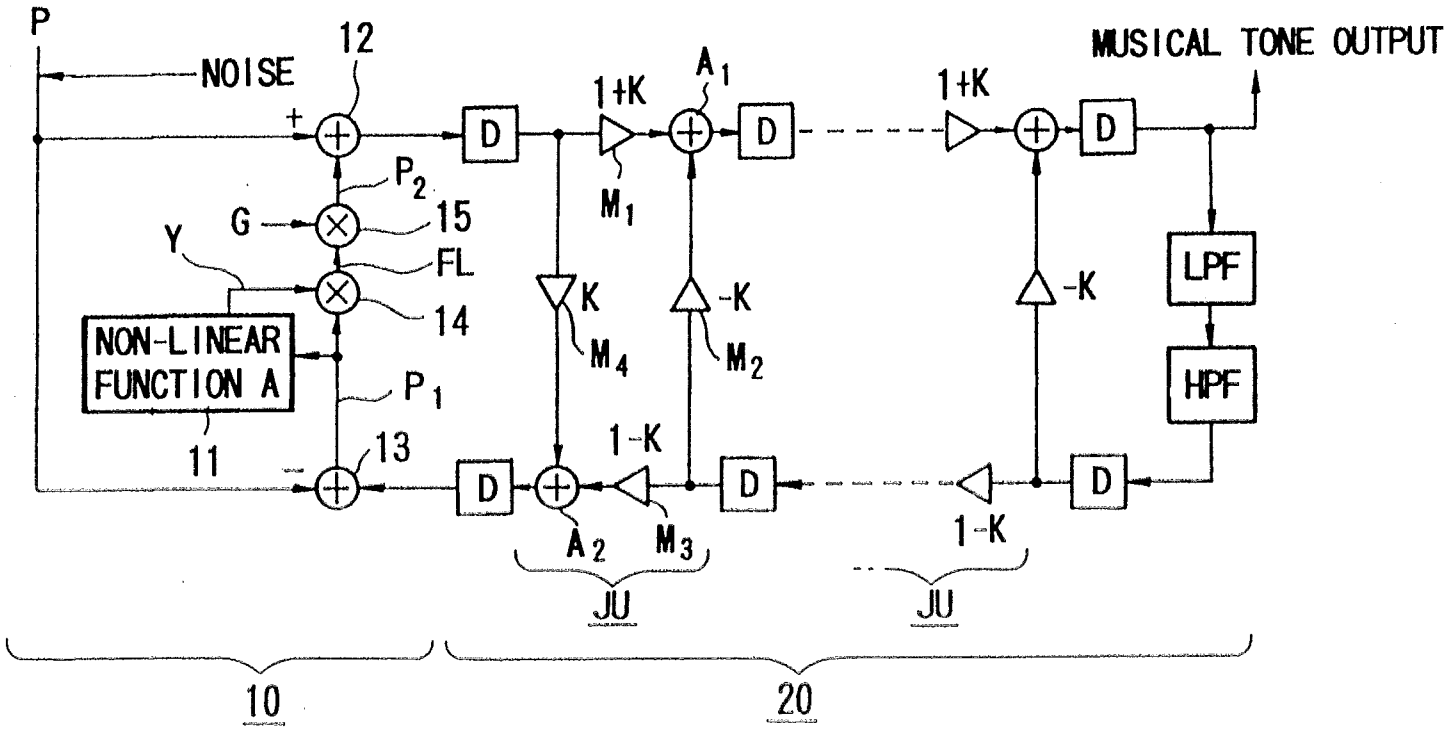
FIG. 15 (PRIOR ART)
FIG. 15 is a block diagram showing the conventional musical tone synthesizing apparatus.

Thus, the noise generator 50 of the first embodiment as shown in FIG. 11 can be simplified in the second embodiment as shown in FIG. 14. In FIG. 14, parts identical to those shown in FIG. 11 will be designated by the same numerals, hence, description thereof will be omitted. Herein, the signal which is produced responsive to the data L is simply multiplied by the data f so as to compute the volume-flow velocity data FLN.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus for synthesizing a musical tone signal comprising:

excitation means for creating an excitation signal corresponding to performance information:

loop means for circulating said excitation signal therein, said loop means including delay means for delaying said excitation signal by a delay time determined in accordance with a pitch of said musical tone signal to be synthesized, wherein a signal circulating through said loop means is extracted and output as a musical tone signal;

noise signal producing means for producing a noise signal in response to said excitation signal;

noise control means for controlling at least one of a frequency characteristic and an amplitude characteristic of said noise signal in response to said excitation signal; and noise convolution means, provided at a predetermined point within said loop means, for convoluting the signal circulating through said loop means with said noise signal.

2. A musical tone synthesizing apparatus as defined in claim 1, wherein said noise control means includes a filter of which operation is controlled by said excitation signal.

3. A musical tone synthesizing apparatus as defined in claim 1, wherein said noise control means includes amplitude varying means for varying an amplitude of said noise signal in accordance with time varying envelope signal.

4. A musical tone synthesizing apparatus as defined in claim 1, wherein said noise control means controls a noise characteristic of said noise signal in response to a time-variation of said excitation signal.

5. A musical tone synthesizing apparatus as defined in claim 1, wherein said excitation means includes performance-input means responsive to an operation by a performer for creating performance information, wherein said excitation means creates said excitation signal corresponding to said performance information.

6. A musical tone synthesizing apparatus as defined in claim 5, wherein said performance-input means includes a mouthpiece portion and detecting means for detecting a performance state of said mouthpiece portion by a performer, said excitation means creating said excitation signal responsive to a detection result of said detecting means.

7. A musical tone synthesizing apparatus as defined in claim 1, wherein said noise signal comprises a white-noise signal having a predetermined uniform spectral distribution.

8. A musical tone synthesizing apparatus as defined in claim 1, wherein said noise signal producing means includes computation means for producing data indicative of noise produced in accordance with a turbulent flow contained in an air-pressure wave propagated through a resonance tube of a wind instrument.

9. A musical tone synthesizing apparatus comprising:

excitation means for generating an excitation signal corresponding to performance information;

loop means for circulating said excitation signal therein, said loop means including delay means for delaying said excitation signal by a delay time corresponding to a pitch of a musical tone to be synthesized;

noise signal producing means for producing a plurality of noise signals having different signal characteristics, said noise signal producing means producing said plurality of noise signals by controlling at least one of a frequency characteristic and an amplitude characteristic of a reference signal;

combination means for combining said plurality of noise signals together to produce a combined noise signal; and convolution means for convoluting a signal circulating through said loop means with said combined noise signal output from said combination means, thereby producing a musical tone signal.

10. A musical tone synthesizing apparatus as defined in claim 9, further comprising noise envelope control means for controlling an amplitude envelope of said combined noise signal in accordance with said excitation signal.

11. A musical tone synthesizing apparatus as defined in claim 9, wherein said noise signal producing means includes a filter, responsive to said excitation signal, for filtering at least one of said plurality of noise signals, said at least one filtered noise signal having a frequency characteristic varied by said filter in accordance with said excitation signal.

12. A musical tone synthesizing apparatus as defined in claim 9, wherein said noise signal producing means produces at least one noise signal which varies in accordance with a variation of said excitation signal.

13. A musical tone synthesizing apparatus as defined in claim 9, wherein said noise signal producing means includes a plurality of noise producing means for producing a corresponding plurality of noise signals.

14. A musical tone synthesizing apparatus as defined in claim 9, wherein said excitation means includes performance-input means responsive to an operation by a performer for creating performance information, wherein said excitation means creates said excitation signal corresponding to said performance information.

15. A musical tone synthesizing apparatus as defined in claim 14, wherein said performance-input means includes a mouthpiece portion and detecting means for detecting a performance state of said mouthpiece portion by a performer, said excitation means creating said excitation signal responsive to a detection result of said detecting means.

16. A musical tone synthesizing apparatus as defined in claim 9, wherein said reference signal comprises a white-noise signal having a predetermined uniform spectral distribution.

17. A musical tone synthesizing apparatus as defined in claim 9, wherein said noise signal producing means includes computation means for producing data indicative of noise produced in accordance with a turbulent flow contained in an air-pressure wave propagated through a resonance tube of a wind instrument.

18. A musical tone synthesizing apparatus as defined in claim 9, wherein said noise signal producing means produces said plurality of noise signals in response to the generation of said excitation signal.

19. A musical tone synthesizing apparatus as defined in claim 18, wherein said noise signal producing means controls said different signal characteristics of said plurality of noise signals in accordance with said excitation signal.

* * * * *